US010368162B2

(12) United States Patent
Sanders

(10) Patent No.: US 10,368,162 B2
(45) Date of Patent: Jul. 30, 2019

(54) METHOD AND APPARATUS FOR RECREATING DIRECTIONAL CUES IN BEAMFORMED AUDIO

(71) Applicant: GOOGLE INC., Mountain View, CA (US)

(72) Inventor: Nicholas Jordan Sanders, Saratoga, CA (US)

(73) Assignee: GOOGLE LLC, Mountain View, CA (US)

( * ) Notice: Subject to any disclaimer, the term of this patent is extended or adjusted under 35 U.S.C. 154(b) by 0 days.

(21) Appl. No.: 14/928,871

(22) Filed: Oct. 30, 2015

(65) Prior Publication Data

US 2017/0127175 A1 May 4, 2017

(51) Int. Cl.

*H04R 1/32* (2006.01)
*H04R 1/40* (2006.01)
*H04R 3/00* (2006.01)

(52) U.S. Cl.

CPC ..... *H04R 1/326* (2013.01); *H04R 1/406* (2013.01); *H04R 3/005* (2013.01); *H04R 2201/403* (2013.01); *H04S 2400/15* (2013.01); *H04S 2420/01* (2013.01)

(58) Field of Classification Search

CPC ..... H04R 29/005; G10L 2021/02166
USPC ..... 381/56, 58, 92
See application file for complete search history.

(56) References Cited

U.S. PATENT DOCUMENTS 7,415,117 B2 8/2008 Tashev et al.
7,991,166 B2 8/2011 Kihara et al.
8,249,269 B2 * 8/2012 Yuzuriha ..... H04M 3/565 381/80
9,226,088 B2 * 12/2015 Pandey ..... H04R 3/005
2009/0313028 A1 * 12/2009 Tammi ..... G10L 19/265 704/500
2010/0158267 A1 * 6/2010 Thormundsson ..... H04R 3/005 381/92
2010/0266139 A1 * 10/2010 Yuzuriha ..... H04M 3/565 381/80

(Continued)

FOREIGN PATENT DOCUMENTS

CN 1826019 A 8/2006
EP 1551205 A1 7/2005

OTHER PUBLICATIONS

Alexandridis, Capturing and Reproducing Spatial Audio, p. 1-16.*

(Continued)

*Primary Examiner* — William A Jerez Lora

(74) *Attorney, Agent, or Firm* — Brake Hughes Bellermann LLP

(57) ABSTRACT

A method and apparatus are disclosed to recreate directional cues and in a conventional beamformed monophonic audio signal. In an example embodiment, the apparatus captures sound in an environment via the microphone array which includes a left reference and a right reference microphone. A monophonic audio signal is generated using conventional beamforming methods. A conventional monophonic beamformed signal lacks directional cues which may be useful for multiple output channels. By applying the phase offset data of the audio signals at the left and right reference microphones, directional cues may be created for audio signals for the left and right output channels respectively.

16 Claims, 10 Drawing Sheets

(56) References Cited

U.S. PATENT DOCUMENTS

| | | | | |
|---|---|---|---|---|
| 2012/0020503 | A1 | 1/2012 | Endo et al. | |
| 2013/0034241 | A1* | 2/2013 | Pandey | H04R 3/005 381/92 |
| 2013/0101136 | A1 | 4/2013 | McElveen | |
| 2015/0030179 | A1* | 1/2015 | Zhang | H04R 3/005 381/92 |
| 2016/0112817 | A1* | 4/2016 | Fan | H04R 29/004 381/94.7 |
| 2016/0267898 | A1* | 9/2016 | Terlizzi | H04R 1/1091 |

OTHER PUBLICATIONS

International Search Report and Written Opinion received for PCT Patent Application No. PCT/US2016/059718, dated Jan. 26, 2017, 8 pages.

First Office Action for Chinese Application No. 201680047607.2, dated Feb. 19, 2019, 6 pages.

* cited by examiner

FIG. 3A (Conventional)
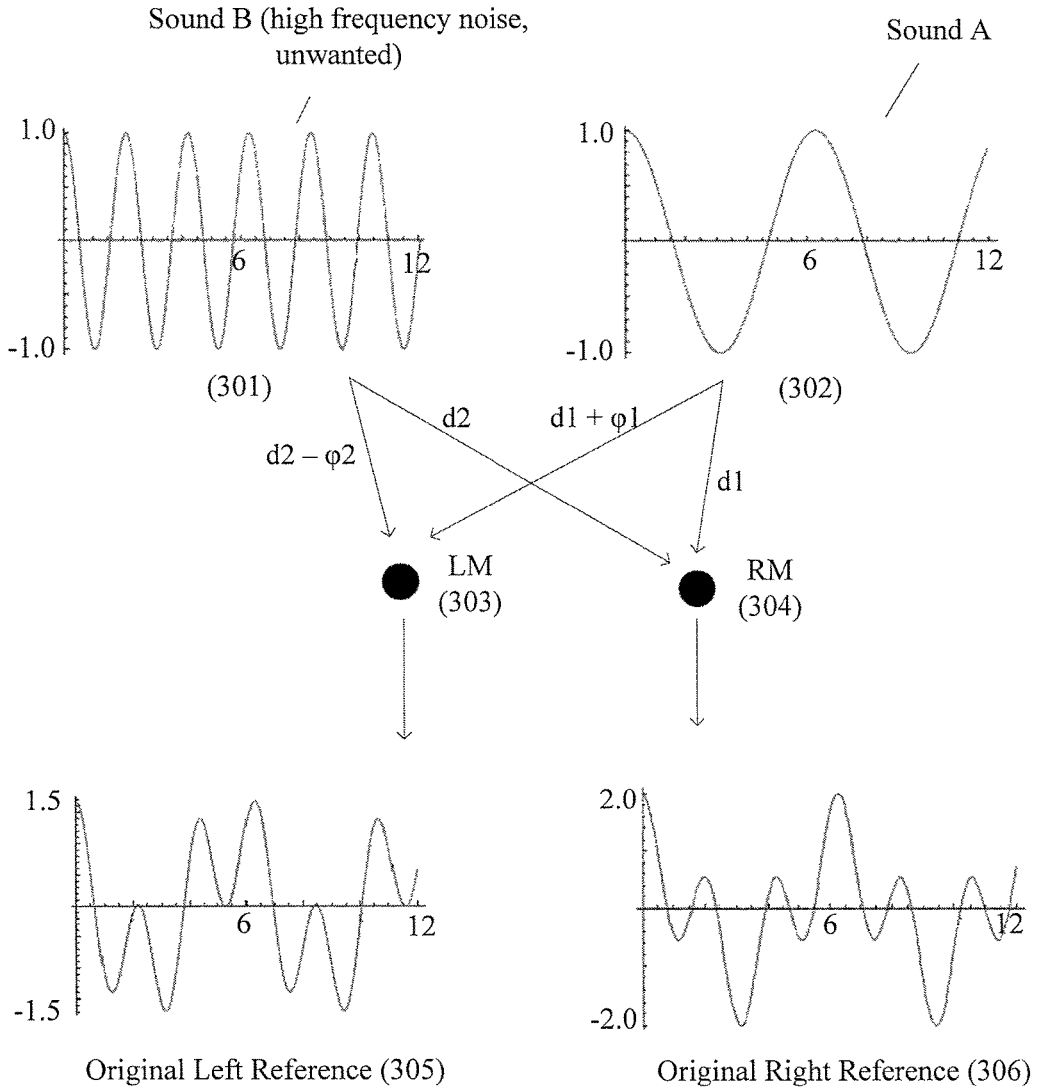

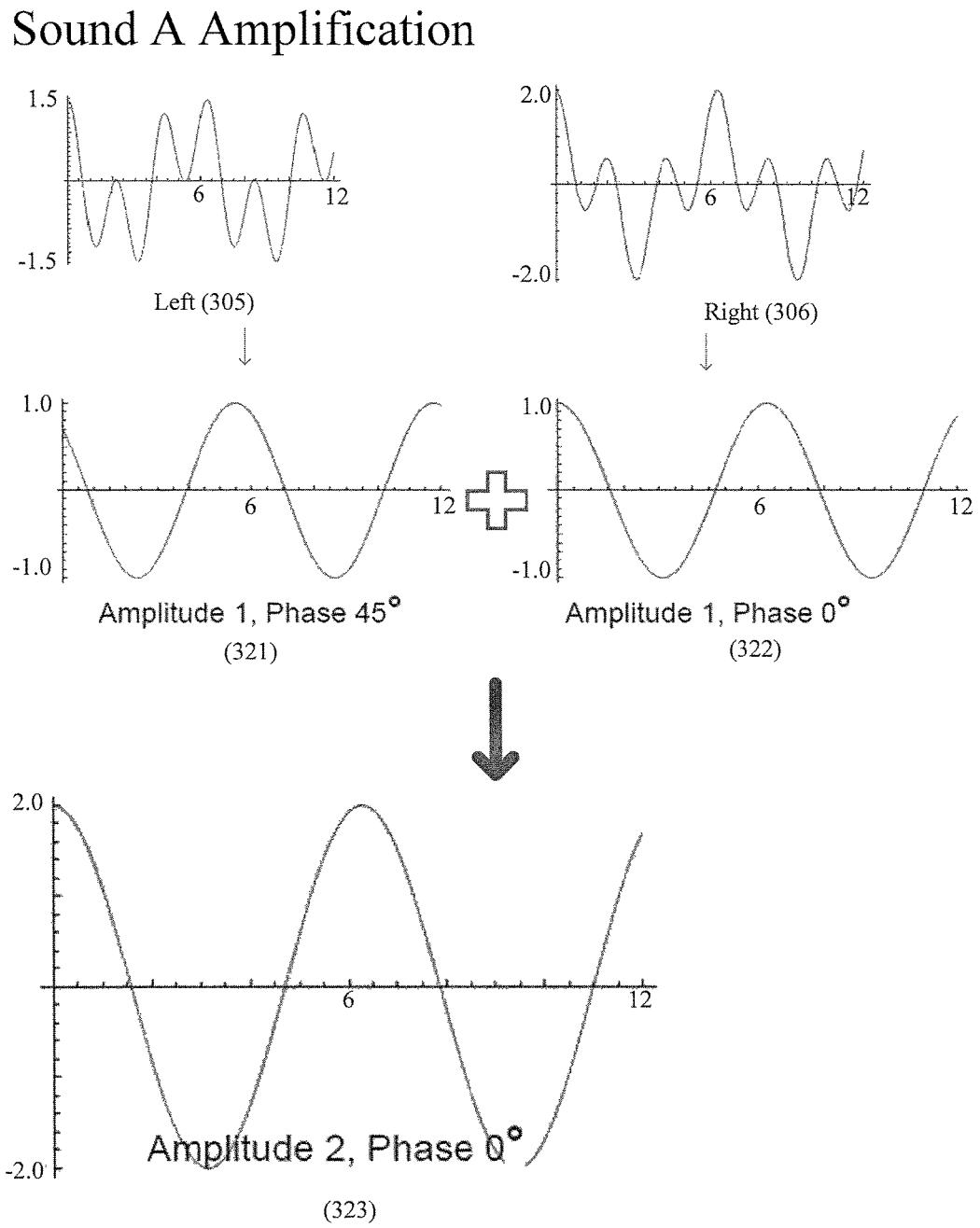
FIG. 3B (Conventional)

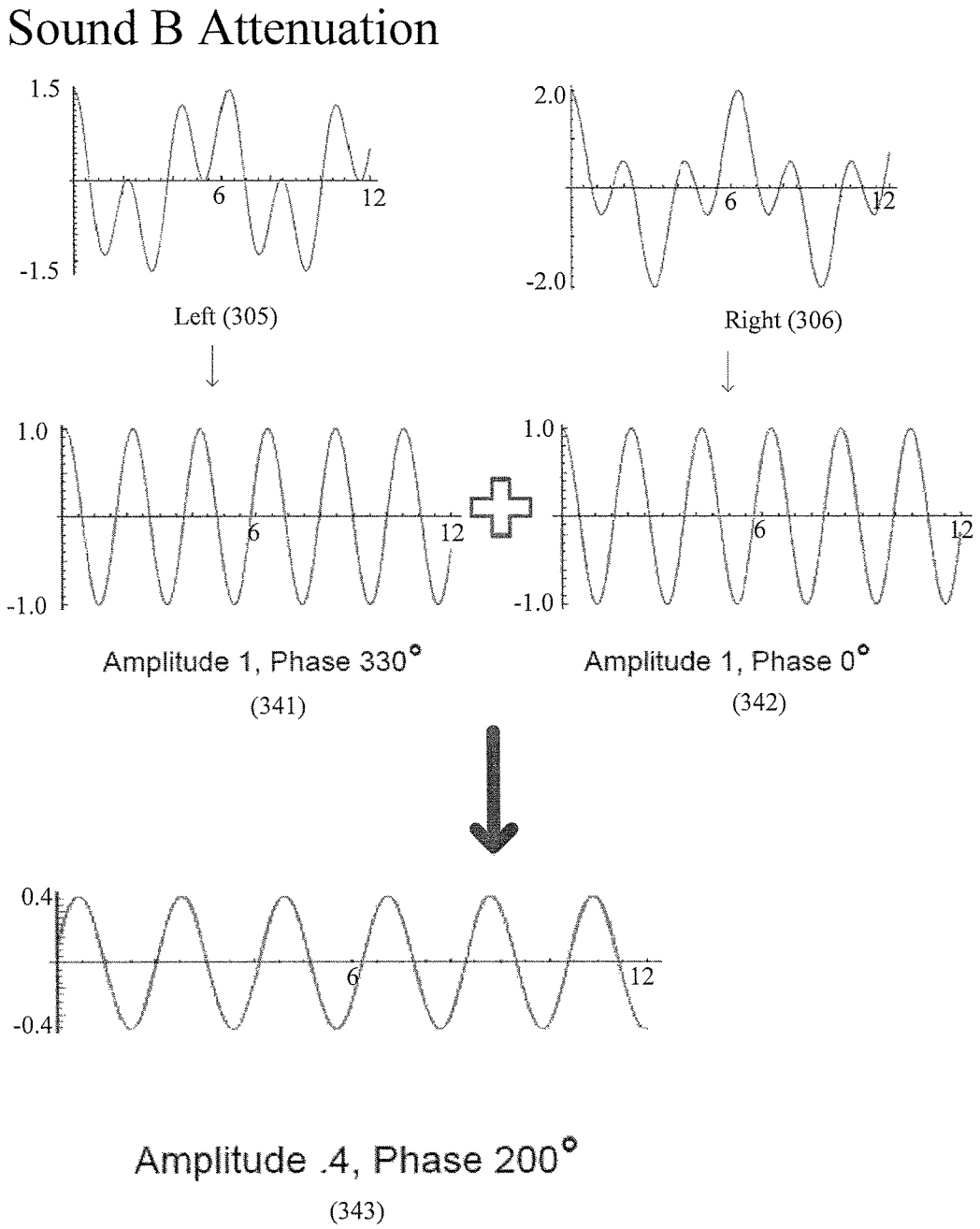
FIG. 3C (Conventional)

FIG. 3D (Conventional)
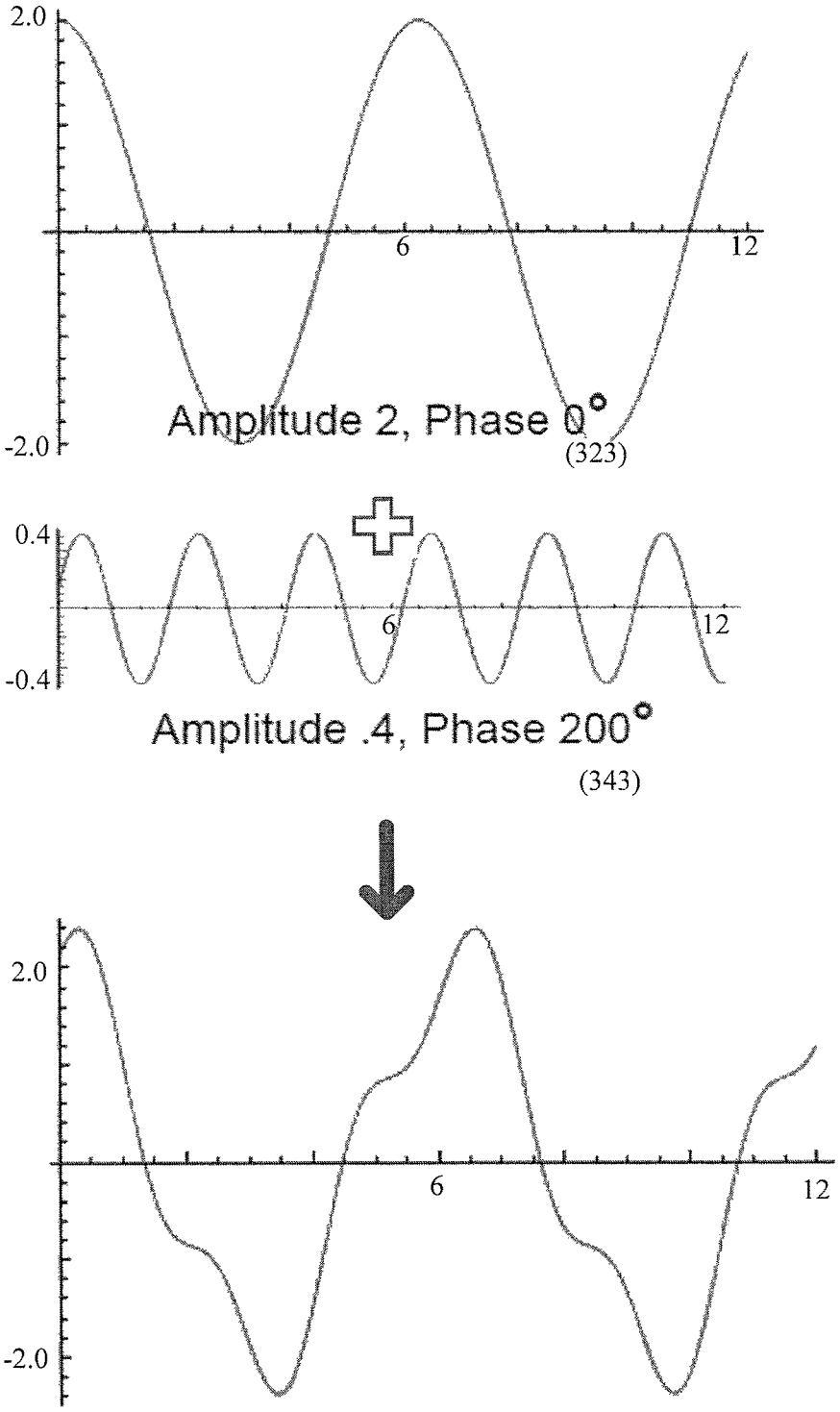
Conventional Beamformed Mono Signal (360)

(Left Channel)

(Right Channel)

Beamformed Right Signal with Directional Cues (413)

(Left Channel)

Original Left Reference (305)

Conventional Beamformed Mono Signal (360)

Beamformed Left Signal with Directional Cues (403)

(Right Channel)

Original Right Reference (306)

Conventional Beamformed Mono Signal (360)

Beamformed Right Signal With Directional Cues (413)

METHOD AND APPARATUS FOR RECREATING DIRECTIONAL CUES IN BEAMFORMED AUDIO

BACKGROUND

Beamforming merges multiple audio signals received from a microphone array to amplify a source at a particular azimuth. In other words, it allows amplifying certain desired sound sources in an environment and reducing/attenuating unwanted noise in the background areas to improve the output signal and audio quality for the listener.

Generally described, the process involves receiving the audio signals at each of the microphones in the array, extracting the waveform/frequency data from the received signals, determining the appropriate phase offsets per the extracted data, then amplifying or attenuating the data with respect to the phase offset values. In beamforming, the phase values account for the differences in time the soundwaves take to reach the specific microphones in the array, which can vary based on the distance and direction of the soundwaves along with the positioning of the microphones in the array. Under conventional beamforming methods, the resulting beamformed audio stream from the several merged audio streams is a monophonic output signal.

SUMMARY

Aspects of the present disclosure generally relate to methods and systems for audio beamforming and recreating directional cues in beamformed audio signals.

An example component includes one or more processing devices and one or more storage devices storing instructions that, when executed by the one or more processing devices, cause the one or more processing devices to implement an example method. An example method may include: receiving audio signal via the microphone array; receiving audio signal via the reference microphones in the array; beamforming the received audio signals to generate beamformed monophonic audio signal; and generating audio signals with directional cues by applying the phase offset information of the reference microphones to the beamformed monophonic audio signal.

These and other embodiments can optionally include one or more of the following features: the reference microphones in the array include a left reference microphone and a right reference microphone; the microphone array includes two or more microphones; and the microphone array includes one or more reference microphones.

BRIEF DESCRIPTION OF DRAWINGS

FIG. 3A graphically illustrates two soundwaves that arrive and are combined at each of the two microphones in an example array.

FIG. 3B graphically illustrates an example beamforming step of amplifying one of the soundwaves shown in FIG. 3A.

FIG. 3C graphically illustrates an example beamforming step of attenuating the other soundwave shown in FIG. 3A.

FIG. 3D graphically illustrates an example beamforming step of generating a monophonic signal where the amplified signal of FIG. 3B is combined with the attenuated signal of FIG. 3C.

DETAILED DESCRIPTION

In view of the limitations of conventional beamforming as described above which only provides a monophonic output signal, the present disclosure provides methods, systems, and apparatus to recreate audio signals with directional cues from a beamformed monophonic audio signal for multiple output channels, such as, for example, stereo.

Figure 1:
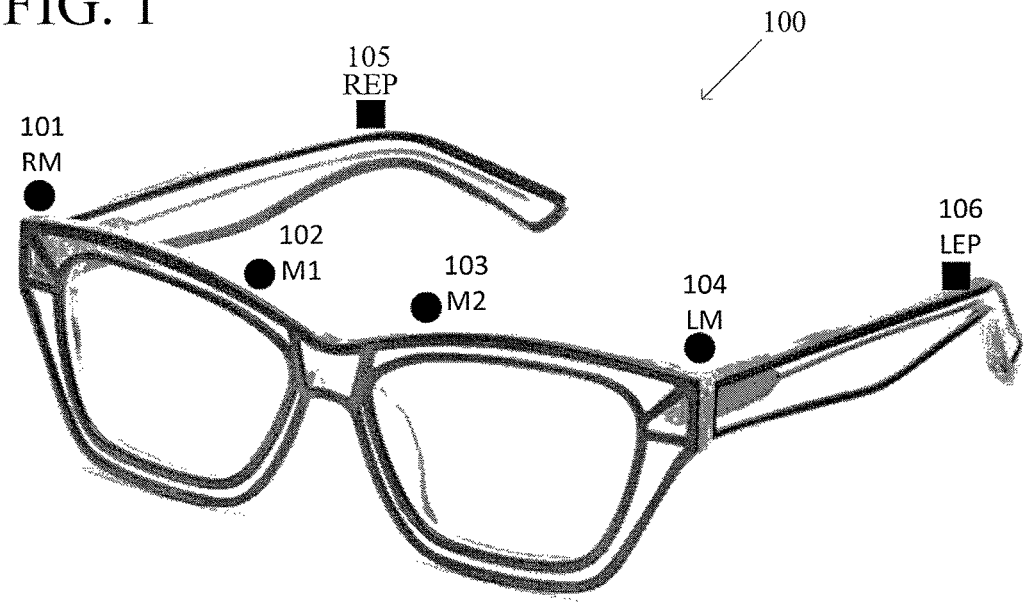
FIG. 1 is an example of a configuration of a microphone array with reference microphones, and audio earpieces positioned on typical eyewear, according to one or more embodiments described herein.

FIG. 1 is an example embodiment of a configuration of a microphone array with reference microphones, and audio output devices (e.g. earpieces) positioned on typical eyewear (100) for a user. The microphone array includes four microphones (101-104), including two reference microphones (101, 104). In this configuration, the left and right reference microphones (104 and 101, respectively) are positioned at locations similar to where a user's ear would be when wearing the eyewear to re-create the directional cues for the left and right earpieces (106, 105) respectively.

In this example embodiment, the microphone array includes four microphones (101-104) positioned along the upper rim of the eyewear (100). The microphones (101-104) are at known relative fixed positions from each other and capture sound from the surrounding environment. The relative fixed positions of the microphones (101-104) in the array allow determination of the delay in the various soundwaves in reaching each of the specific microphones (101-104) in the array in order to determine the phase values for beamforming.

The configuration also includes two earpieces (105, 106), a left earpiece (106) and a right earpiece (105), which may provide the left and right channel audio signals with the directional cues based on the left and right reference microphones (104, 101) respectively. In this example, the configuration may be implemented as a hearing aid where the captured sound via the microphone array (101-104) is beamformed. Then an output signal with directional cues for the left earpiece (106) may be recreated using data from the left reference microphone (104), and an output signal with directional cues for the right earpiece (105) may be created using data from the right reference microphone (101). This example configuration is only one of numerous configurations that may be used in accordance with the embodiment described herein, and is not in any way intended to limit the scope of the present disclosure. Other embodiments may include different configurations of audio input and output sources.

Figure 2:
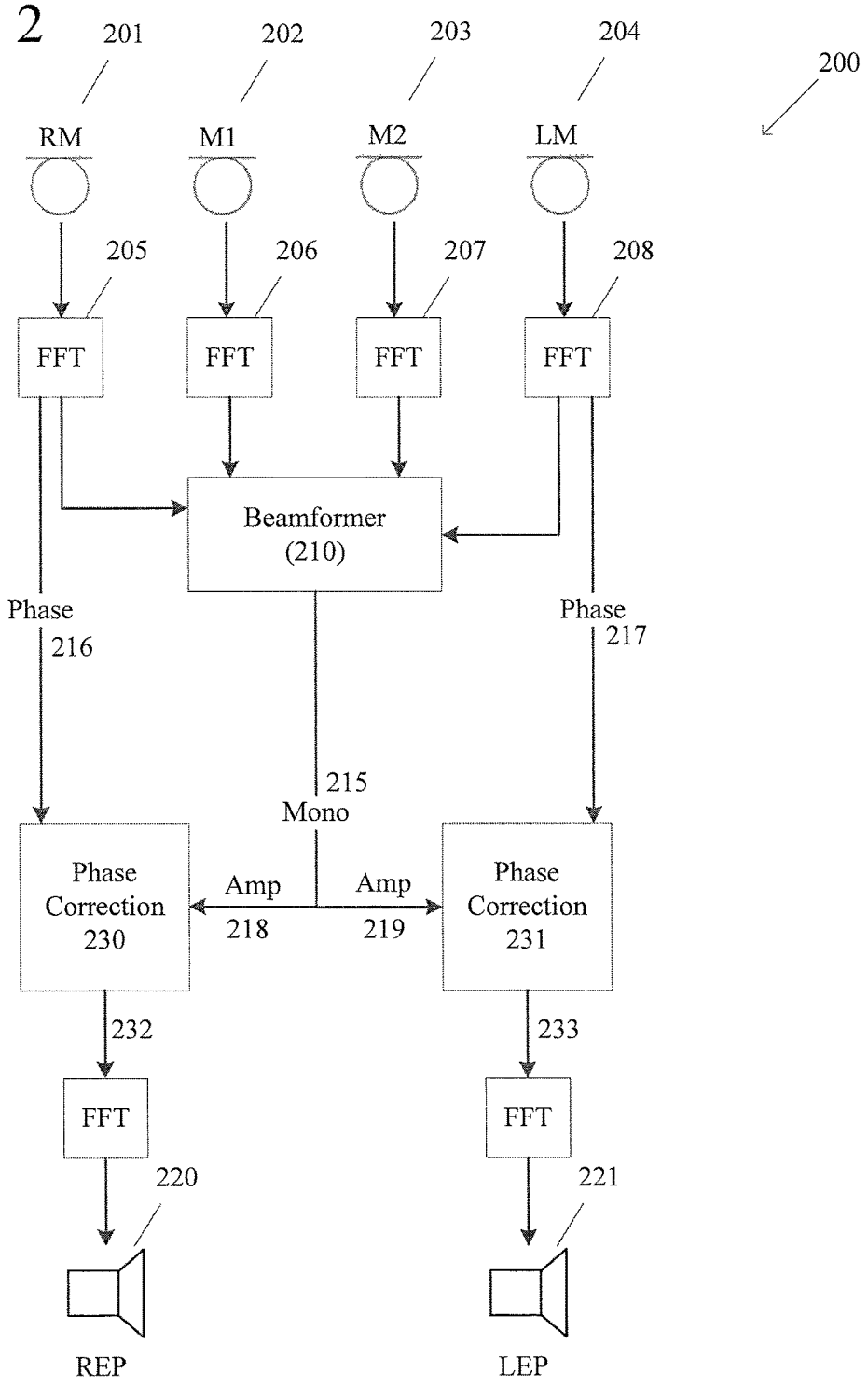
FIG. 2 is a block diagram illustrating an example system for recreating audio signals with directional cues, according to one or more embodiments described herein.

FIG. 2 is an example system (200) for recreating audio signals with directional cues, according to one or more embodiments described herein. The system (200) includes four microphones (201-204) in a microphone array, including a left reference microphone (204) and a right reference microphone (201). Audio signals are received at each of the microphones and transformed to a frequency domain representation using, for example, Fast Fourier Transform (FFT) (205-208). The signal data for each of the microphones is combined via beamformer (210) using conventional methods resulting in a single monophonic signal (215). Beamforming combines the audio signals from each of the microphones (201-204) to amplify the desired sound and attenuate the unwanted noise in the background environment resulting in a single mono signal (215); however, a mono signal (215) does not contain the directional cue information that may be beneficial for stereo or multiple output channels.

In accordance with one or more embodiments described herein, phase correction (230, 231), using the phase information (216, 217) from each of the reference microphones (201, 204) and the amplitude data (218, 219) from the mono signal (215), recreates directional cues into FFTs (232, 233) to generate the final audio output signal. The phase information (217) from the left reference microphone (204) is applied to the amplified mono signal (215) and outputted to the left earpiece (221). The phase information (216) from the right reference microphone (201) is applied to the amplified mono signal (215) and outputted to the right earpiece (220). The final phase corrected audio signals (232, 233) outputted to the left and right earpieces (220, 221) contain the respective directional cues captured at the reference microphones (201, 204).

FIGS. 3A-D illustrate a conventional beamforming process which amplifies desired sound, attenuates unwanted noise, and generates the beamformed monophonic signal. FIG. 3A illustrates two sound waves (301, 302) that arrive and are combined at each of the two microphones in the example microphone array (303, 304). Sound A is low frequency desired sound coming from the right direction. Sound B is high frequency undesired sound coming from the left direction.

In this example configuration, the microphone array includes two microphones (303, 304), both of which are also reference microphones. 302 represents the waveform from Sound A. 301 represents the waveform from Sound B. The d1 arrow refers to Sound A arriving at the right reference microphone, RM (304). The d1+φ1 arrow refers to Sound A arriving at the left reference microphone, LM (303). The φ1 represents the phase offset which accounts for the additional time it takes Sound A to reach LM (303) as compared to RM (304). The d2 arrow refers to Sound B arriving at RM (304). The d2-φ2 arrow refers to Sound B arriving at LM (303). The φ2 phase offset represents the lesser time it takes Sound B to reach LM (303) than it does RM (304).

Sound A and Sound B from the environment are combined together at different phase offsets due to the differences in time it takes for each of the signals to travel to each of the microphones in the array (303, 304). Waveform 305 reflects the combined sound data at LM (303), and waveform 306 reflects the combined sound data at RM (304). The following should be noted with respect to these waveforms: While the shape of the waveforms are very different, they will sound the same to a human listener as a monophonic stream. However, as a stereo stream, a human listener will hear the difference in phase offsets of each frequency as a directional indicator.

FIG. 3B illustrates the beamforming step of extracting and amplifying Sound A from the audio signals received by the microphone array. Using frequency extraction, such as FFT, Sound A's frequency (302) is extracted from each of the waveforms (305, 306) of the microphones (303, 304) in the array receiving Sound A. For LM (303), Sound A frequency (302) is extracted from waveform 305 resulting in waveform 321 with an amplitude of 1 and a phase offset (φ) of 45 degrees. For RM (304), Sound A frequency (302) is extracted from waveform 306 resulting in waveform 322 with an amplitude of 1 and a phase offset of 0 degrees. Here, the phases align, thus the Sound A frequency (302) is amplified 2× resulting in an amplitude of 2 at a phase of 0 degrees. As a note, the new amplified frequency does not retain the phase offset value of 45 degrees from the left reference microphone waveform 321.

FIG. 3C illustrates the beamforming step of extracting and attenuating Sound B from the audio signals received by the microphone array. Similar to above in FIG. 3B, using frequency extraction, the Sound B frequency (301) is extracted from the waveforms 305 and 306 for the left and right microphones (303, 304) respectively. Sound B frequency is extracted from waveform 305 resulting in waveform 341 with an amplitude of 1 and a phase offset (φ) of 330 degrees. For RM (304), Sound B frequency (301) is extracted from waveform 306 resulting in waveform 342 with an amplitude of 1 and a phase offset of 0 degrees. Here, the phases do not align, thus the Sound B frequency (301) is attenuated, resulting in an amplitude of 0.4 at a phase of 200 degrees. As a note, the new attenuated frequency does not retain the phase offset value of 330 degrees from the left reference microphone as depicted in waveform 341.

FIG. 3D illustrates the final beamforming step of generating the monophonic signal 360 where the amplified frequency 323 from FIG. 3B is combined with the attenuated frequency 343 from FIG. 3C. As shown, this final waveform 360 is much closer to waveform 302 from Sound A than either microphone individually (305, 306). However, this final monophonic signal 360, which amplifies the desired sound, i.e. Sound A, does not contain the directional cues that are in the original signals (305, 306).

Figure 4A:
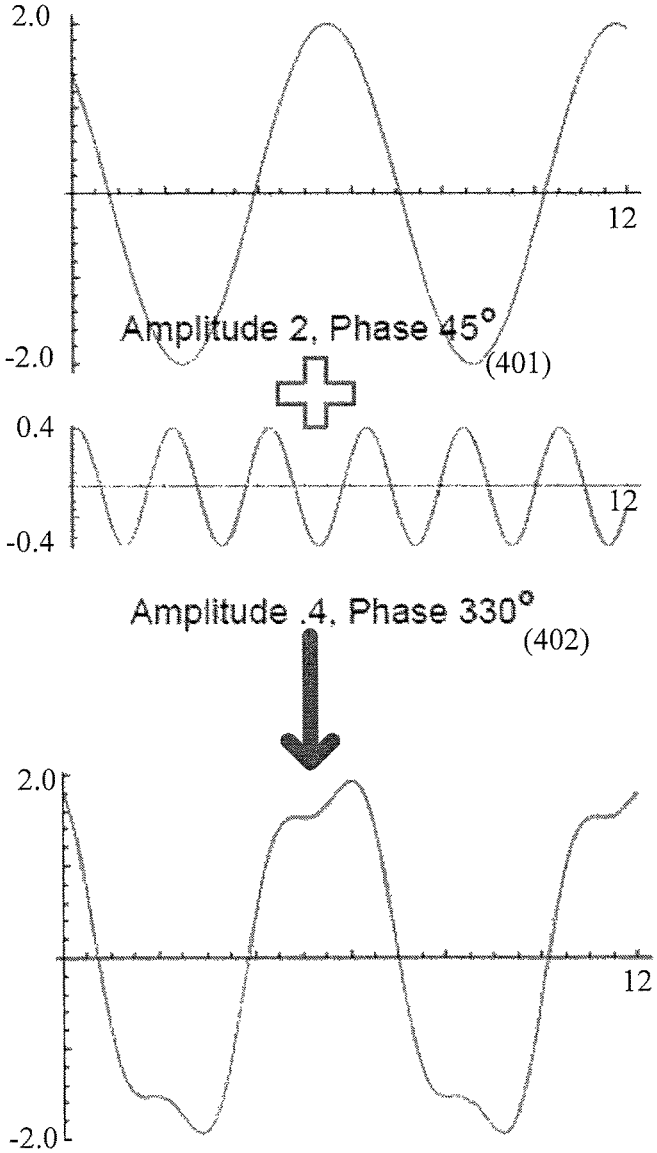
FIG. 4A graphically illustrates generating an audio signal with directional cues for a left output channel, according to one or more embodiments described herein.

FIGS. 4(A-B) illustrates generating audio signals with directional cues for the left and right output channels. FIG. 4A illustrates generating an audio signal with directional cues for a left output channel. Waveform 401 depicts an audio signal of Sound A with an amplitude value of 2 and phase value of 45 degrees. The amplitude value of 2 is derived from the conventional beamformed mono signal depicted in waveform 343. The phase value of 45 degrees is derived from the original left reference signal depicted in waveform 321.

Waveform 402 depicts an attenuated signal of Sound B with an amplitude value of 0.4 and phase value of 330 degrees. The 0.4 amplitude is derived from conventional beamformed mono signal depicted in waveform 323. The phase value of 330 degrees is derived from the original left reference signal depicted in waveform 341.

Signals depicted in waveforms 401 and 402, using the left reference phase values of 45 degrees and 330 degrees, are combined to generate the audio signal for the left channel output which is depicted as waveform 403 and contains the directional cues from the left reference microphone, LM (303).

Figure 4B:
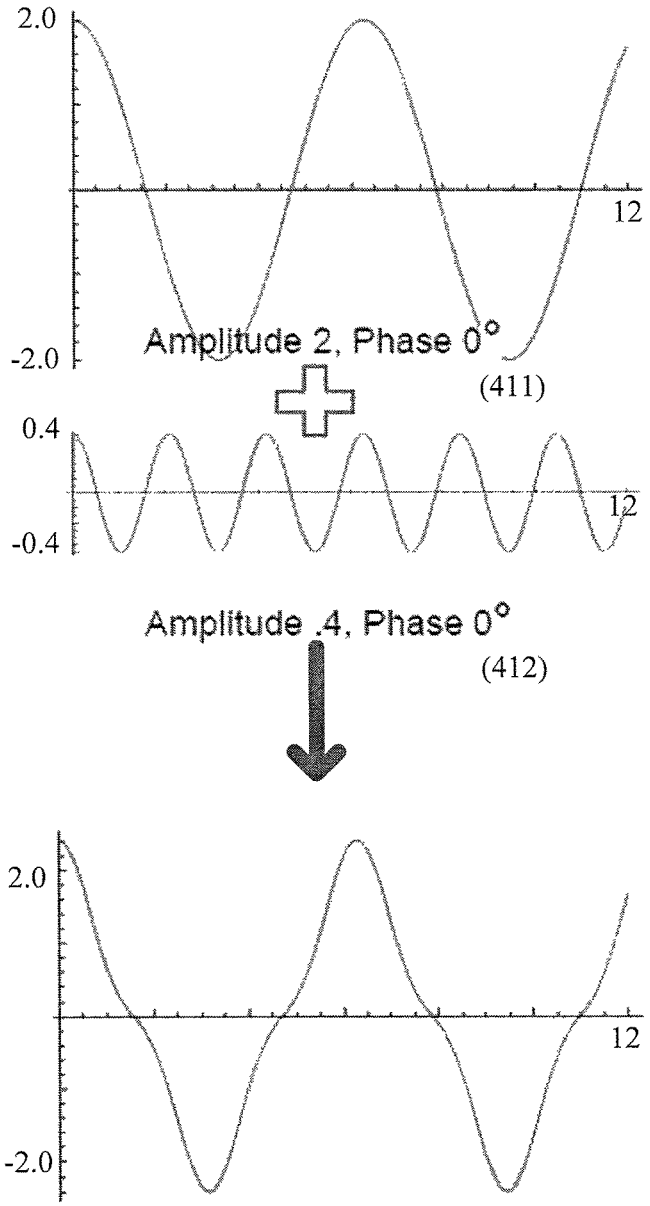
FIG. 4B graphically illustrates generating an audio signal with directional cues for a right output channel, according to one or more embodiments described herein.

FIG. 4B illustrates generating an audio signal with directional cues for a right output channel. Waveform 411 depicts an audio signal of Sound A with an amplitude value of 2 and phase value of 0 degrees. The amplitude value of 2 is derived from the conventional beamformed mono signal depicted in waveform 343. The phase value of 0 degrees is derived from the original right reference signal depicted in waveform 322.

Waveform 412 depicts an attenuated signal of Sound B with an amplitude value of 0.4 and phase value of 0 degrees. The 0.4 amplitude is derived from the conventional beamformed mono signal depicted in waveform 323. The phase value of 0 degrees is derived from the original right reference signal depicted in waveform 342.

Signals depicted as waveforms 411 and 412, using the right reference phase values of 0 degrees and 0 degrees, are combined to generate the audio signal for the right channel signal which is depicted as waveform 413 and contains the directional cues from the right reference microphone, RM (304).

FIGS. 5(A-B) is a set of graphical representations comparing the waveform patterns for the audio signals at the original reference microphones, the beamformed conventional signal, and the left/right signals containing the directional cues. FIG. 5A shows the waveforms (305, 360, 403) depicting the audio signals originally received at the left reference microphone, LM (303), the monophonic signal generated via conventional beamforming (360), and the audio signal with directional cues for the left channel (403). As can be seen by comparing the three waveforms, the final waveform 403 with directional cues is more similar to the original left reference waveform 305 than the monophonic waveform 360 and still provides the amplified/attenuated pattern of the beamformed signal 360.

Figure 5A:
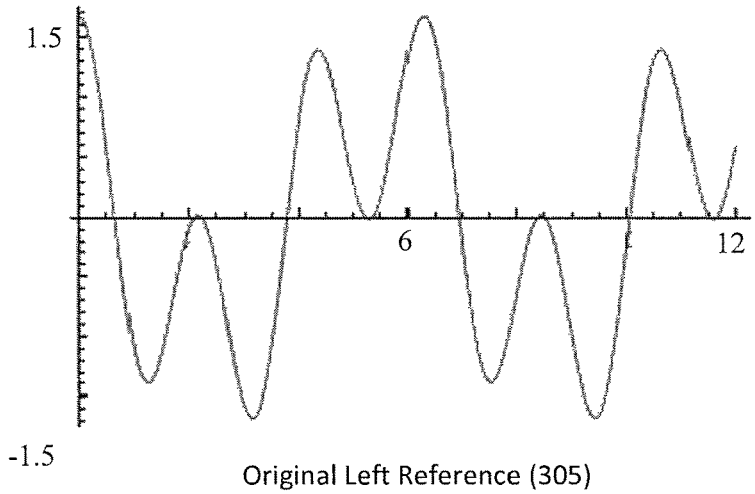
FIG. 5A is a set of graphical representations comparing the waveform patterns for: the original signal at the left reference microphone shown in FIG. 3A, the conventional monophonic beamformed signal shown in FIG. 3D, and the audio signal with directional cues for the left output channel shown in FIG. 4A.
Figure 5A:
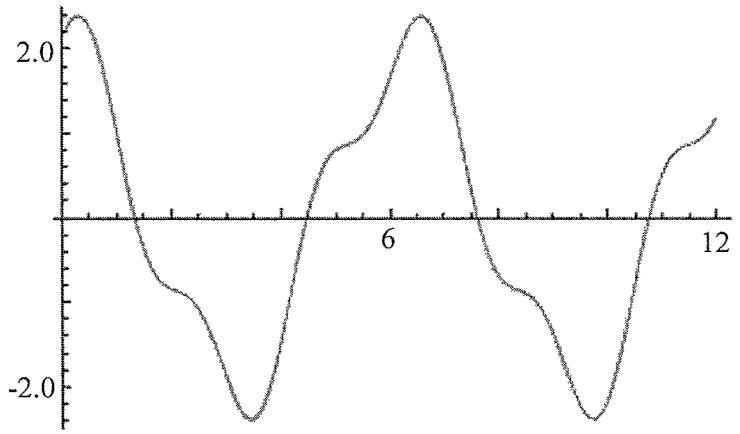
Figure 5A:
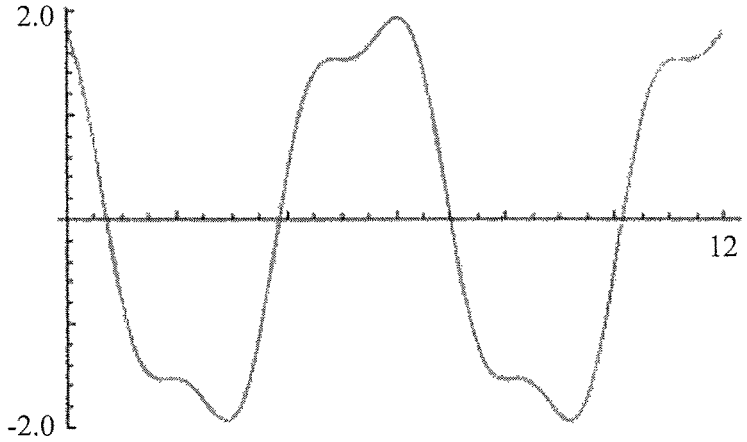
Figure 5B:
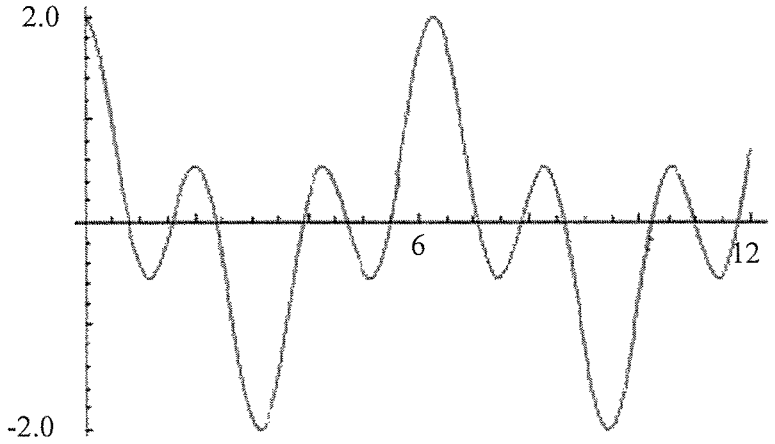
FIG. 5B is a set of graphical representations comparing the waveform patterns for: the original signal at the right reference microphone shown in FIG. 3A, the conventional monophonic beamformed signal shown in FIG. 3D, and the audio signal with directional cues for the right output channel shown in FIG. 4B.
Figure 5B:
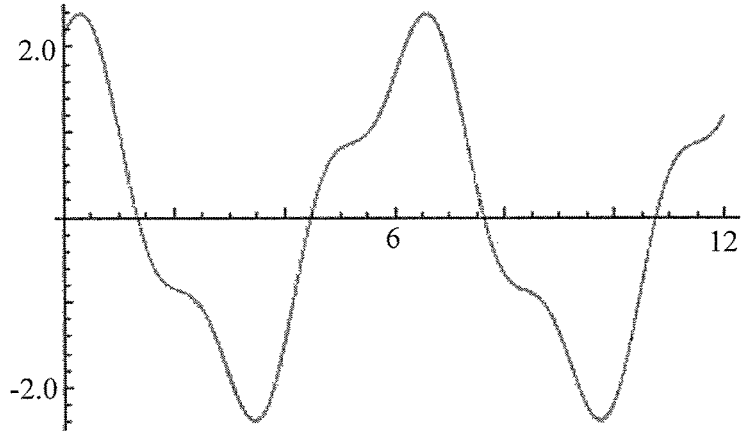
Figure 5B:
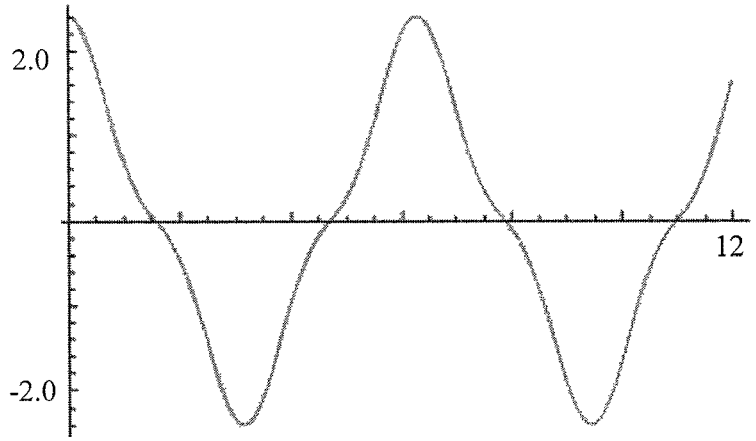

FIG. 5B shows the waveforms (306, 360, 413) depicting the audio signals originally received at the right reference microphone, RM (304), the monophonic signal generated via conventional beamforming (360), and the audio signal with directional cues for the right channel (413). As can be seen by comparing the three waveforms, the final waveform 413 with directional cues is more similar to the original right reference waveform 306 than the monophonic waveform 360 and still provides the amplified/attenuated pattern of the beamformed signal 360. As compared to the conventional mono beamformed signal, the relative alignment of peaks and valleys which form the directional cues in the right and left reference signals match with the right and left beamformed signals.

I claim:

1. A method for recreating directional cues in beamformed audio, the method comprising:

receiving at least one first audio signal via a microphone array;

receiving at least one second audio signal via the microphone array;

receiving at least one third audio signal via at least one reference microphone;

transforming the at least one first audio signal, the at least one second audio signal and the at least one third audio signal to a frequency domain representation;

beamforming amplitude data of the at least one transformed first audio signal, the at least one transformed second audio signal and the at least one transformed third audio signal to generate a beamformed monophonic audio signal;

deriving phase offset information based on a frequency extracted during the transforming of the at least one third audio signal and the beamformed monophonic audio signal; and generating a multi-channel audio signal with directional cues by applying the derived phase offset information to the beamformed monophonic audio signal.

2. The method of claim 1, wherein the at least one reference-microphone in the array includes two or more microphones, and the two or more microphones include a left reference microphone and a right reference microphone.

3. The method of claim 1, wherein the microphone array includes two or more microphones.

4. The method of claim 1, wherein the microphone array includes the at least one reference microphone.

5. An apparatus for recreating directional cues in beamformed audio, the apparatus comprising:

one or more processing devices to:

receive at least one first audio signal via a microphone array;

receive at least one second audio signal via the microphone array;

receive at least one third audio signal via at least one reference microphone;

transform the at least one first audio signal, the at least one second audio signal and the at least one third audio signal to a frequency domain representation;

beamform amplitude data of the at least one transformed first audio signal, the at least one transformed second audio signal and the at least one transformed third audio signal to generate a beamformed monophonic audio signal;

derive phase offset information based on a frequency extracted during the transforming of the at least one third audio signal and the beamformed monophonic audio signal; and generate a multi-channel audio signal with directional cues by applying the derived phase offset information to the beamformed monophonic audio signal.

6. The apparatus of claim 5, wherein the at least one reference-microphone in the array includes two or more microphones, and the two or more microphones include a left reference microphone and a right reference microphone.

7. The apparatus of claim 5, wherein the microphone array includes two or more microphones.

8. The apparatus of claim 5, wherein the microphone array includes the at least one reference microphone.

9. The method of claim 1, wherein the at least one first audio signal is a left side audio signal, the at least one second audio signal is a right side audio signal, the at least one reference microphone includes a first reference microphone and a second reference microphone, and the multi-channel audio signal is a stereo signal generated using first phase offset information corresponding to the left side audio signal and second phase offset information corresponding to the right side audio signal.

10. The apparatus of claim 5, wherein the at least one first audio signal is a left side audio signal, the at least one second audio signal is a right side audio signal, the at least one reference microphone includes a first reference microphone and a second reference microphone, and the multi-channel audio signal is a stereo signal generated using first phase offset information corresponding to the left side audio signal and second phase offset information corresponding to the right side audio signal.

11. The method of claim 1, wherein the transform of the at least one third audio signal is a transform to a frequency domain representation including amplitude information and the phase offset information.

12. The apparatus of claim 5, wherein the transform of the at least one third audio signal is a transform to a frequency domain representation including amplitude information and the phase offset information.

13. The method of claim 1, wherein beamforming the at least one first audio signal, the at least one second audio signal and the at least one third audio signal generates a beamformed monophonic audio signal, and the monophonic audio signal is amplified and directional cues associated with the at least one first audio signal and the at least one second audio signal are removed.

14. The apparatus of claim 5, wherein beamforming the at least one first audio signal, the at least one second audio signal and the at least one third audio signal generates a beamformed monophonic audio signal, and the monophonic audio signal is amplified and directional cues associated with the at least one first audio signal and the at least one second audio signal are removed.

15. The method of claim 1, wherein beamforming the at least one first audio signal, the at least one second audio signal and the at least one third audio signal generates a beamformed monophonic audio signal, the monophonic audio signal is amplified and directional cues associated with the at least one first audio signal and the at least one second audio signal are removed, and generating the multi-channel audio signal includes adding the directional cues associated with the at least one first audio signal and the at least one second audio signal to the beamformed monophonic audio signal.

16. The apparatus of claim 5, wherein beamforming the at least one first audio signal, the at least one second audio signal and the at least one third audio signal generates a beamformed monophonic audio signal, the monophonic audio signal is amplified and directional cues associated with the at least one first audio signal and the at least one second audio signal are removed, and generating the multi-channel audio signal includes adding the directional cues associated with the at least one first audio signal and the at least one second audio signal to the beamformed monophonic audio signal.

* * * * *